US011896193B2

(12) United States Patent
Nezami et al.

(10) Patent No.: US 11,896,193 B2
(45) Date of Patent: Feb. 13, 2024

(54) METHOD FOR INFLUENCING THE DEVICE-TYPICAL SOUND EMISSION OF A CLEANING DEVICE

(71) Applicant: Vorwerk & Co. Interholding GmbH, Wuppertal (DE)

(72) Inventors: Amin Nezami, Wuppertal (DE); Nicolai Stenzel, Wuppertal (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 18 days.

(21) Appl. No.: 17/879,002

(22) Filed: Aug. 2, 2022

(65) Prior Publication Data

US 2023/0045868 A1 Feb. 16, 2023

(30) Foreign Application Priority Data

Aug. 3, 2021 (EP) ..... 21189411

(51) Int. Cl.
*A47L 9/28* (2006.01)
*A47L 9/00* (2006.01)

(52) U.S. Cl.
CPC ..... *A47L 9/2831* (2013.01); *A47L 9/0081* (2013.01)

(58) Field of Classification Search
CPC .... A47L 9/2831; A47L 9/0081; A47L 9/0686; A47L 9/2805; A47L 9/2836; A47L 9/2857; A47L 11/4088; A47L 9/248
See application file for complete search history.

(56) References Cited

U.S. PATENT DOCUMENTS

2006/0070203 A1 4/2006 Fischer

FOREIGN PATENT DOCUMENTS

| | | | |
|---|---|---|---|
| DE | 10 114 634 | A1 | 9/2002 |
| DE | 10 2004 041 075 | A1 | 3/2006 |
| DE | 10 2010 031 560 | A1 | 1/2012 |
| WO | WO2016105076 | A1 * | 6/2016 |

* cited by examiner

*Primary Examiner* — David Redding
(74) *Attorney, Agent, or Firm* — Collard & Roe, P.C.

(57) ABSTRACT

A method for influencing the device-typical sound emission of a cleaning device, wherein the cleaning device has a device housing and a cleaning mechanism for carrying out a cleaning activity on a surface to be cleaned, wherein the cleaning device emits device-typical sound while carrying out the cleaning activity, and wherein the device-typical sound is detected and analyzed with respect to at least one sound frequency contained therein. In order to adapt the soundscape of the cleaning device in such a way that a user can ascertain a proper functionality of the cleaning device, a displaceable section assigned to a flow channel of the cleaning device is displaced relative to the flow channel and/or the device housing in dependence on the analysis result until a characteristic sound frequency for the cleaning activity emitted by the cleaning mechanism has a defined amplitude.

16 Claims, 4 Drawing Sheets

Fig. 3
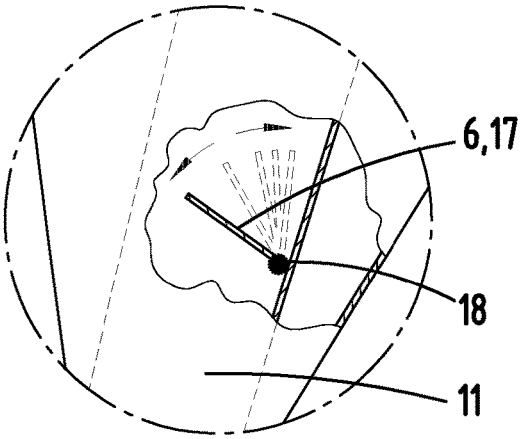
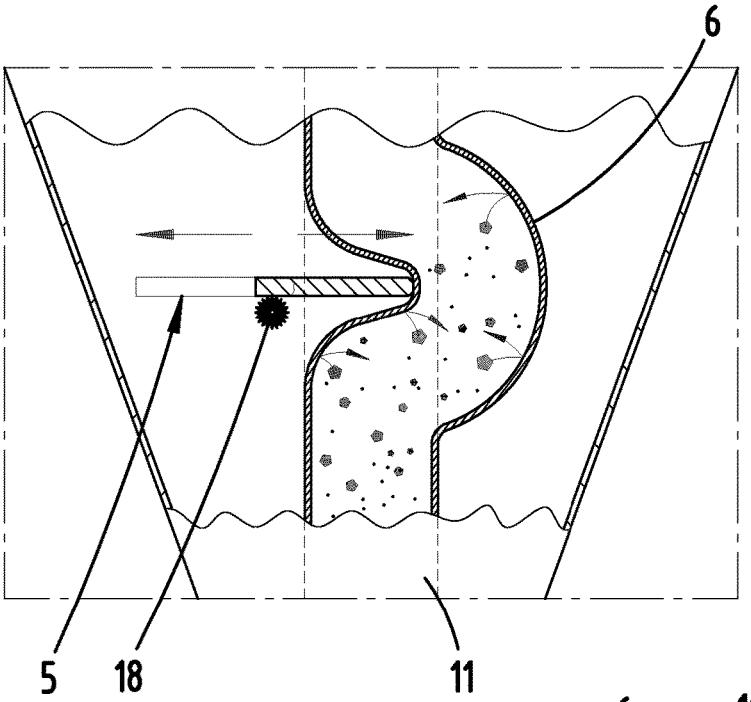
Fig. 4
Fig. 5
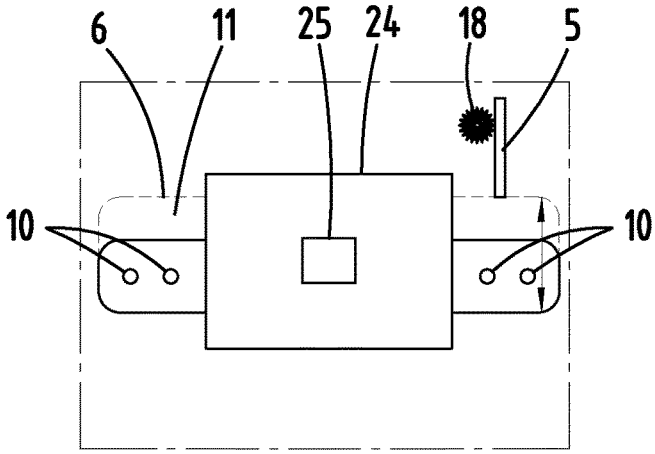

METHOD FOR INFLUENCING THE DEVICE-TYPICAL SOUND EMISSION OF A CLEANING DEVICE

CROSS REFERENCE TO RELATED APPLICATIONS

Applicant claims priority under 35 U.S.C. § 119 of European Application No. 21189411.8 filed Aug. 3, 2021, the disclosure of which is incorporated by reference.

BACKGROUND OF THE INVENTION

1. Field of the Invention

The invention pertains to a method for influencing the device-typical sound emission of a cleaning device, wherein the cleaning device has a device housing and a cleaning mechanism for carrying out a cleaning activity on a surface to be cleaned, wherein the cleaning device emits device-typical sound while carrying out the cleaning activity, and wherein the device-typical sound is detected and analyzed with respect to at least one sound frequency contained therein.

2. Description of the Related Art

Methods of the aforementioned type are sufficiently known from the prior art. For example, the cleaning devices may be vacuuming devices, wiping devices or also combinations thereof.

The prior art discloses different measures for improving a sound quality of a cleaning device during a cleaning activity, particularly with respect to the subjective perception of a plurality of users.

The probably best-known measures concern sound absorption devices, wherein dominant frequencies of the sound are purposefully absorbed or attenuated. For example, there exist sound insulation measures, which with respect to vacuum cleaning devices surround a fan of the cleaning device. There also exist noise reduction methods that are based on noise cancellation. Corresponding methods are disclosed, for example, in DE 10 2010 031 560 A1 or US 2006/0070203 A1. In addition, there exist sound synthesis methods, in which the own frequencies of the device are supplemented with synthetically generated frequencies. This makes it possible to realize the operating noise of the cleaning device in a more agreeable manner for a user. A corresponding method is disclosed, for example, in DE 10 2004 041 075 A1. It is furthermore known from DE 10 114 634 A1 to synthesize typical functional noises of a vacuum cleaner and to reproduce the synthesized functional noises by means of a corresponding device of the vacuum cleaner, e.g. in order to inform the user of the proper functionality of the cleaning device. In this respect, it is possible to accentuate, for example, the soundscape generated when vacuuming up crumbs.

Although the aforementioned methods proved successful in the prior art, they have specific disadvantages. A sound absorption frequently requires an enlargement of the device housing of the cleaning device in order to accommodate the corresponding sound insulation elements in the cleaning device. Noise cancellation methods or sound synthesis methods are frequently unsatisfactory for preserving the most natural acoustic pattern possible of the cleaning device and for ascertaining a proper functionality of the cleaning device.

SUMMARY OF THE INVENTION

Based on the aforementioned prior art, the invention aims to influence the device-typical sound of the cleaning device in such a way that a user can ascertain a proper function of the cleaning device and the most natural soundscape possible is preserved.

In order to attain this objective, it is proposed that a displaceable section assigned to a flow channel of the cleaning device is displaced relative to the flow channel and/or the device housing in dependence on the analysis result until a sound frequency, which is characteristic for the cleaning activity and emitted by the cleaning device, has a defined amplitude.

A euphony of the cleaning device initially can be achieved, in principle, by means of a noise reduction. The lower the sound emission of the cleaning device, the more easily and effectively the overall sound can be realized. Usual noise reduction measures are, for example, component decouplings from the device housing in order to interrupt structure-borne sound transmission chains as far as possible. Sound absorbers that absorb sound waves contained in the air flow are also conceivable. Adjustments for preventing vibrations that are perceived as annoying during the operation of the cleaning device can already be made during the manufacture of the cleaning device with the aid of vibration analyses concerning the frequencies emitted by certain components and component assemblies. Once these options are successfully exploited, the cleaning device can, in principle, be operated below an objectionable sound level. However, the cleaning device may then possibly operate so quietly that the user can no longer ascertain the proper function of the cleaning device. Cleaning devices, the operating noise of which does not correspond to the expectations of a user, e.g. due to significant sound absorption, frequently are perceived as unsuitable for carrying out a cleaning activity satisfactorily. If the cleaning device operates in an excessively quiet manner, for example, the user believes that the cleaning activity is not properly carried out. On the other hand, insufficient sound absorption, for example, may cause the user to perceive the operation of the cleaning device as objectionable.

According to the invention, a section of the cleaning device, which respectively is assigned or belongs to the flow channel, is additionally or alternatively to the aforementioned measures displaced until a certain sound frequency or multiple sound frequencies have a desired amplitude. According to the invention, the displaceable section is assigned to a flow channel because flow channels usually represent a relevant sound source while gases or liquids flow through them. The proposed method particularly can already be carried out by a manufacturer of the cleaning device during its manufacture. A detection device that is suitable for detecting the device-typical sound of the cleaning device is used for the detection of the device-typical sound. The detected measuring signals are subsequently transmitted to a computing device that evaluates the sound with respect to the characteristic sound frequencies contained therein. The computing device particularly can generate a frequency spectrum of the sound emitted by the cleaning device. The detection device particularly can be arranged in the region of the flow channel or in the flow channel of the cleaning device itself in order to detect precisely the sound portions being propagated by the air flow conducted in the flow channel. The section assigned to the flow channel can then be displaced in dependence on the analysis result until the relevant sound frequencies, the sound amplitude of which should be changed, have a defined amplitude. The displacement of the section assigned or belonging to the flow channel may either take place manually or—as particularly preferred—by means of an automatically controlled displacement device that displaces the section of the cleaning device until the characteristic sound frequency has a defined amplitude. This may particularly also take place in a fully automated manner in the course of a control process, in which the detection device measures the emitted sound frequencies and the computing device evaluates the relevant characteristic sound frequencies and correspondingly controls the displacement device in order to adjust a defined amplitude. The aforementioned steps can then be carried out once again in order to determine how the sound spectrum was changed. It is particularly preferred that the displacement of the section of the cleaning device and the detection and evaluation of the sound take place continuously and simultaneously until the optimal position for the displaceable section is found. The optimal position is characterized in that the sound frequency to be adjusted has a defined amplitude, which may be a possible maximum value or minimum value or also an amplitude predefined by the manufacturer of the cleaning device. Since the displaceable section of the cleaning device is assigned to a flow path, via which sound portions can be transmitted, in particular, to the device housing of the cleaning device or to an outlet opening of the flow path, the displaceable section of the cleaning device works as an optimal means for influencing the sound spectrum of the cleaning device.

In this context, it would particularly be possible to carry out the method in the course of a self-learning control of the cleaning device. In this case, the manufacturer or the user can specify a defined acoustic pattern that should be reached during the operation of the cleaning device. Measures for actively influencing the sound can be applied for reaching the specified acoustic pattern, wherein sound frequencies contained in the device-typical sound are continuously detected, evaluated and influenced based on a measurement carried out during the operation of the cleaning device, e.g. by means of at least one microphone in the cleaning device or alternatively an external terminal of the cleaning device. If it is detected that the device-typical sound currently differs from the specified acoustic pattern, a displaceable section of the cleaning device can be displaced, e.g. by operating an actuator, wherein an influence of this displacement on the acoustic pattern, i.e. the emitted sound frequencies, is then monitored in the course of a training phase. Environmental influences, as well as operating parameters of the cleaning device, can be taken into account in the analysis. Based on specified properties of the acoustic pattern and due to neural networking, the cleaning device learns over time the sound-changing adjustment, by means of which the cleaning device can be optimally operated within the defined ranges for the sound frequencies contained in the device-typical sound. In order to also take into account the individual sound perception of a user, the cleaning device may provide input options, by means of which the user can transmit feedback regarding his personal sound perception to the cleaning device. In a simple embodiment, this may be a button, upon the actuation of which the user transmits information to the effect that the current sound of the cleaning device is perceived as annoying. A personal evaluation by the user may alternatively or additionally also be actively requested, e.g. by displaying a corresponding request on a display unit of the cleaning device or on an external terminal that is communicatively linked to the cleaning device. An input by the user can also be realized, in particular, by means of a touch-sensitive display.

According to a potential embodiment, the cleaning device may be a vacuum cleaning device with a device housing and a fan arranged therein, wherein the device housing has referred to an air conveying direction of the fan an inlet opening and an outlet opening, wherein the cleaning device has a flow channel with a suction air region and a clean air region, wherein the suction air region connects the inlet opening to the fan in a flow-conducting manner and the clean air region connects the fan to the outlet opening in a flow-conducting manner, and wherein the suction air region and/or the clean air region has a displaceable section, which can be manually or automatically displaced until a characteristic sound frequency emitted by the fan or generated in the flow channel has a defined amplitude. The flow path in a vacuum cleaning device generally is divided into two regions, namely a suction air region and a clean air region. The suction air region concerns the flow path that is located upstream of an element for separating vacuumed material, e.g. a filter bag or a cyclone filter. The clean air region concerns the portion of the flow channel, which is located downstream of the fan and through which cleaned air flows. Since this clean air region is located on the output side of the fan, sound generated by a fan motor or a fan wheel of the fan usually is transported along up to the outlet opening of the cleaning device. A purposeful adaptation of a section of the cleaning device can now be carried out in the clean air region, as well as in the suction air region, namely by displacing the section relative to the flow channel and/or the device housing. For example, a different flow routing can be achieved within the cleaning device, particularly within the flow channel, due to the displacement of the section such that defined sound frequencies of the cleaning device are amplified or reduced. The displaceable section assigned to the flow channel may additionally or alternatively to a flow deflection also cause a changed sound absorption. For example, a sound-absorbing element arranged in the flow of the flow channel can be displaced in order to decrease or increase the sound absorption. In addition, the invention makes it possible to influence the original flow noises, as well as the sound emissions of the fan motor and the fan wheel carried along in the flow. A changed position or orientation of the displaceable section changes the absorption properties and/or varies the amplitudes of certain frequencies or entire frequency ranges within the cleaning device.

Furthermore, the cleaning device may also be a wet-cleaning device with a wet-cleaning element for acting upon the surface to be cleaned and with a liquid application device for applying liquid on the wet-cleaning element and/or the surface to be cleaned, wherein the liquid application device has a flow channel with an outlet opening for discharging liquid, and wherein the flow channel has a displaceable section, which can be manually or automatically displaced until a characteristic sound frequency emitted by the liquid application device or generated in the flow channel has a defined amplitude. The flow channel of the wet-cleaning device serves for conveying a liquid flow from a liquid container to the outlet opening, which correspondingly delivers the liquid to the wet-cleaning element or directly to the surface to be cleaned. A pump usually is assigned to the liquid application device in order to convey the liquid to the outlet opening of the flow channel. The pump generates noises that are characterized by a certain sound frequencies. These sound frequencies likewise can be carried along the flow channel with the liquid and perceived by a user. A displaceable section may be assigned to the flow channel in order to adapt the noise emission and, in particular, to realize this noise emission as being agreeable for the user, wherein said displaceable section is purposefully displaced until one or more characteristic sound frequencies generated by the liquid application device and/or the flowing liquid have a defined frequency and in the process are either amplified are reduced.

With respect to a vacuum cleaning device, as well as with respect to a wet-cleaning device or a combination thereof, it would be possible to displace a flexible section of the flow channel or a deflection element that can be displaced into the flow channel. With respect to a vacuum cleaning device, for example, an active displacement of the section can be carried out in the suction air region of the flow channel such that a deflection of the vacuumed material and/or the air flow is achieved. This in turn makes it possible to amplify, for example, crackling noises generated by the dirt, e.g. crumbs, being vacuumed up and conveyed in the flow channel. The user can thereby be informed of a current cleaning power of the cleaning device, wherein the user receives a confirmation of the proper functionality of the cleaning device. In an exemplary embodiment, the displaceable section may be a flexible suction channel section, which is displaced sideward from a straight alignment of the flow channel such that the flow channel extends in a curved manner after the displacement of the suction channel section. Only little impact noises usually are generated on the inner wall of the flow channel in a straight alignment. However, vacuumed material particles can contact the inner wall of the flow channel more frequently once the section is displaced out of the straight arrangement. The impact noises on the inner wall are thereby amplified. It would furthermore be conceivable, for example, to pivot a displaceable deflection element into the flow channel. The displaceable deflection element may be realized, for example, in the form of a deflector plate, on which vacuumed material particles are reflected and therefore impact on the inner wall of the flow channel multiple times. With respect to the clean air region of the flow channel, i.e. the region of the flow channel located downstream of the fan, it would be possible, for example, to displace a displaceable air separation edge into the flow channel such that a stall of the clean air flowing past is provoked and a characteristic noise, which is interpreted as proper functionality of the cleaning device by the user, is generated. The same principle can also be applied to a wet-cleaning device, wherein a displaceable section is pivoted, for example, into the flow channel of the cleaning device or the liquid flow is deflected with a displaceable deflection element. This also makes it possible to vary the noise emission of the cleaning device, e.g. in order to amplify the characteristic noises of the liquid flow and to thereby inform the user of the current liquid flow to the outlet opening of the flow channel, which in turn indicates proper moistening of the cleaning element.

It is furthermore proposed that the section is displaced until the amplitude of the characteristic sound frequency reaches a maximum. This embodiment aims to amplify special sound frequencies that are characteristic for the respective functionality of the cleaning device. With respect to a vacuum cleaning device, this makes it possible to amplify crackling noises that are generated by the impact of a hard vacuumed material such as crumbs on an inner wall of the flow channel. With respect to a wet-cleaning device, for example, it is possible to amplify characteristic sound frequencies in the form of flow noises generated by moistening of the cleaning element. The user usually perceives these noises as agreeable and evaluates them as information on a successful work activity of the cleaning device. As a supplement to this, it is also possible to reduce other frequencies of the cleaning device, e.g. by means of absorption measures or noise cancellation. A contrast between the frequencies to be amplified and the frequencies to be reduced can thereby be increased. It is also possible, in principle, to additionally use a sound generator for sound synthesis. This allows the purposeful generation of a sound that effectively supplements the own emission spectrum of the cleaning device such that an altogether more agreeable soundscape of the cleaning device is achieved.

According to a particularly preferred embodiment of the cleaning device, the amplitude of the characteristic sound frequency for the cleaning activity is adjusted in dependence on an operating mode of the cleaning device and/or a power setting of the cleaning device and/or on a floor type of the surface to be cleaned and/or on accessories connected to the cleaning device. The emitted sound frequencies of the cleaning device usually are related to one or more defined operating modes or operating points, in which the cleaning device can be operated. For example, an operating mode is characterized by a defined rotational speed of a fan motor or by a defined flow speed within the flow channel or in flow-through elements such as dirt separators, i.e. filter bags, cyclone filters, permanent filters and the like. In addition, an operating mode may also be defined by a certain pumping power of the liquid pump or an associated flow speed of the liquid through the flow channel. A floor type of a surface to be cleaned also affects the noises of the cleaning device, for example, because sound is reflected stronger on a hard floor than on a soft floor such as a carpeted floor. Furthermore, characteristic sound frequencies may be generated in dependence on an accessory used with the cleaning device, e.g. by a certain suction nozzle with a rotating cleaning element or the like or by a certain wiping element with an oscillating wiping plate or the like. Consequently, the characteristic sound frequencies of the cleaning device may on the one hand be caused by hardware of the cleaning device, but on the other hand also be influenced by the surroundings and/or the mode of operation of the cleaning device, particularly by a certain power setting of the driving motor or a certain flow speed of air or liquid.

Different positions of the displaceable section to be adjusted for different operating modes and/or for different power settings of the cleaning device and/or for different accessories connectable to the cleaning device particularly may be predefined by the manufacturer and stored in a memory of the cleaning device. The predefined positions are stored in an internal memory of the cleaning device. When the user selects an operating mode or a power setting, e.g. by means of a selector switch arranged on the cleaning device, the control and evaluation unit can access the memory and adjust the corresponding position of the displaceable section. In addition, the manufacturer may also predetermine defined positions to be adjusted when the cleaning device is connected to a certain accessory. For example, a detection unit of the cleaning device can detect which accessory is currently connected to a base unit of the cleaning device and transmit a corresponding signal to the control and evaluation unit, wherein the control and evaluation unit subsequently accesses the data stored in the memory and determines which position to be adjusted corresponds to the currently used accessory. The control and evaluation unit can then transmit a control command to a displacement device in order to adjust the position for the displaceable section of the cleaning device. It is alternatively also possible that a purely mechanical displacement of the section assigned to the flow channel takes place when the accessory is connected to the base unit of the cleaning device, e.g. by means of a sliding element that is displaced when the accessory is connected to the base unit of the cleaning device and acts upon the displaceable section. All in all, the plurality of defined positions for different operating modes, power settings and/or accessories also allows an adaptation of the soundscape of the cleaning device after the delivery of the cleaning device to the customer.

It is therefore proposed, in particular, that a control and evaluation unit of the cleaning device accesses the stored positions, determines a position to be adjusted in dependence on an operating mode adjusted by a user and/or a power setting adjusted by a user and/or an accessory connected to the cleaning device and transmits a control command to an actuator assigned to the displaceable section in order to displace the section into the position to be adjusted. The adjustment of the optimal position of the displaceable section therefore takes place in a fully automated manner as a result of a control command of the control and evaluation unit. As soon as the control and evaluation unit detects that the user has adjusted a certain operating mode or a certain power setting or that a certain accessory is connected to the cleaning device, the displacement of the section assigned to the flow channel is initiated such that the noises emitted, for example, in the respective operating mode or at the respective power setting of the cleaning device are advantageously changed, particularly in such a way that the user does not perceive the operating noises of the cleaning device as objectionable or annoying, but rather perceives the operating noises as agreeable, wherein the user particularly can also assign these operating noises to a certain operating mode, a certain power setting or a connected accessory and thereby ascertain that the cleaning device operates as desired.

Furthermore, a user of the cleaning device may manually transmit a control command for displacing the section to a control and evaluation unit of the cleaning device. As mentioned above, the user may implicitly transmit the control command, for example, by actuating a selector switch for selecting an operating mode and/or a power setting of the cleaning device. In this case, an optimal position for the section assigned to the flow channel can be adjusted without being noticed by the user. Alternatively, the user also can deliberately select a certain soundscape and transmit a corresponding control command to the cleaning device. A communication interface may be provided on the cleaning device for this purpose. For example, different adjustment options can be presented to the user on the cleaning device, e.g. on a touchscreen with buttons for selecting certain noise alternatives. For example, noise scenarios such as "whisper-quiet", "competent" or "powerful" may be offered to the user. Alternatively, the user may also make corresponding adjustments on an external terminal, particularly a mobile terminal such as a mobile telephone or the like. An application that enables the user to transmit a control command to the control and evaluation unit of the cleaning device may be installed on the external terminal.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings,

FIG. 3 shows a flow channel of a cleaning device with a displaceable section according to a first embodiment;

FIG. 4 shows a flow channel of a cleaning device with a displaceable section according to a second embodiment;

FIG. 5 shows a flow channel of a cleaning device with a displaceable section according to a third embodiment;

DETAILED DESCRIPTION OF PREFERRED EMBODIMENTS

Figure 1:
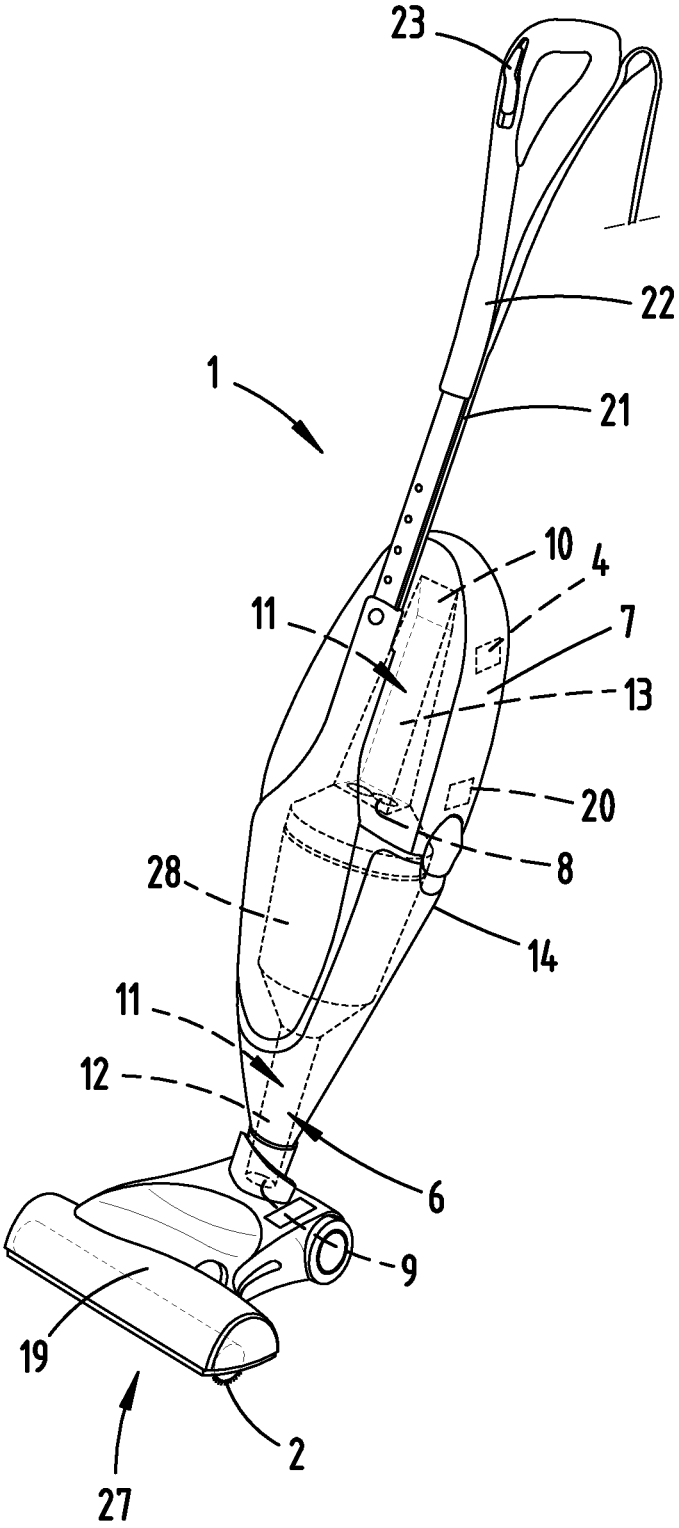
FIG. 1 shows a cleaning device according to a first embodiment.

FIG. 1 shows a first embodiment of an inventive cleaning device 1, which in this case is designed in the form of a vacuum cleaning device, namely a conventional household vacuum cleaner. The cleaning device 1 has a base unit 14 and an accessory 19 that is separably connected to the base unit. In this example, the accessory 19 is a suction nozzle with a suction mouth 27 and a cleaning mechanism 2 assigned to the suction mouth 27. The cleaning mechanism 2 is in this case designed in the form of a cleaning brush that rotates about an essentially horizontal axis. The base unit 14 has a device housing 7 with a shaft 21 and a handle 22, by means of which a user can operate the cleaning device 1. The user usually moves the cleaning device 1 over a surface to be cleaned in the form of forward and backward movements while carrying out a cleaning activity. The handle 22 of the cleaning device 1 has a switch 23 that enables the user to adjust, for example, different operating modes and/or power settings of the cleaning device 1, e.g. power settings of a fan 8. A flow channel 11 and a fan 8 are arranged within the device housing 7 of the cleaning device 1, wherein said fan can draw material to be vacuumed up from a surface to be cleaned into a vacuumed material chamber 28 of the base unit 14. The flow channel 11 connects an inlet opening 9 to an outlet opening 10, which are respectively formed in the device housing 7. The inlet opening 9 of the base unit 14 can be connected to a corresponding accessory 19, wherein the suction mouth 27 of the accessory 19 can be acted upon with a vacuum by means of the fan 8 of the base unit 14. The flow channel 11 of the cleaning device 1 is divided into a suction air region 12 and a clean air region 13, which are separated by the fan 8. The suction air region 12 is located on the suction side of the fan 8 and connects the inlet opening 9 to the fan 8 whereas the clean air region 13 is arranged on the output side of the fan 8 and fluidically connects the fan 8 to the outlet opening 10 of the flow channel 11.

Figure 6:
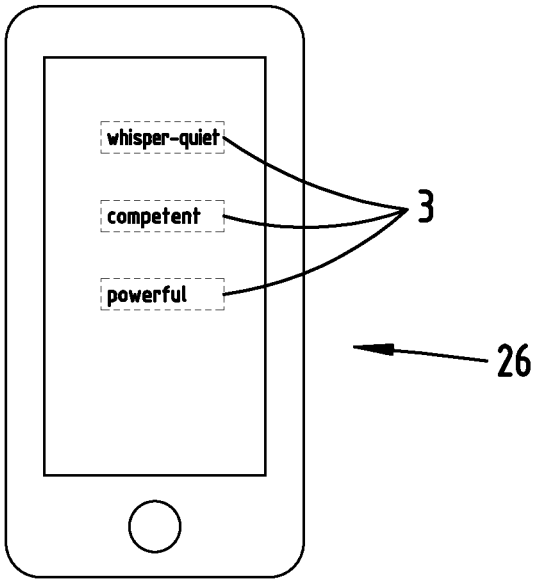
FIG. 6 shows an external terminal for communicating with the inventive cleaning device.
Figure 7:
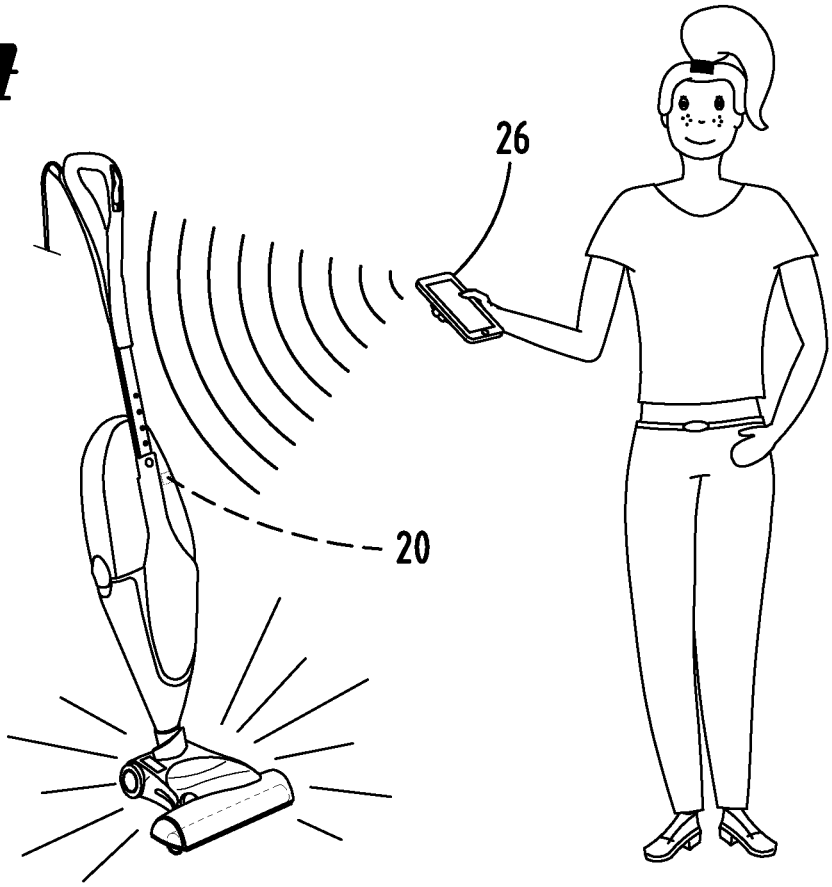
FIG. 7 shows a system with a cleaning device and an external terminal.

The cleaning device 1 furthermore is equipped with a communication interface 20 for communicating with an external terminal 26 (see FIGS. 6 and 7). The manufacturer of the cleaning device or a user can communicate with a control and evaluation unit 4 of the cleaning device 1 by means of the external terminal 26. The communication interface 20 preferably is a wireless communication interface 20 such as a Bluetooth interface or a WLAN interface or the like.

In addition, a displaceable section 6 is assigned to the flow channel 11 of the cleaning device 1 and can be respectively displaced relative to the flow channel 11 or the device housing 7 of the cleaning device 1. The flow channel 11 and the assigned displaceable section 6 may be designed in different ways as described in greater detail below with reference to FIGS. 3 to 5.

Figure 2:
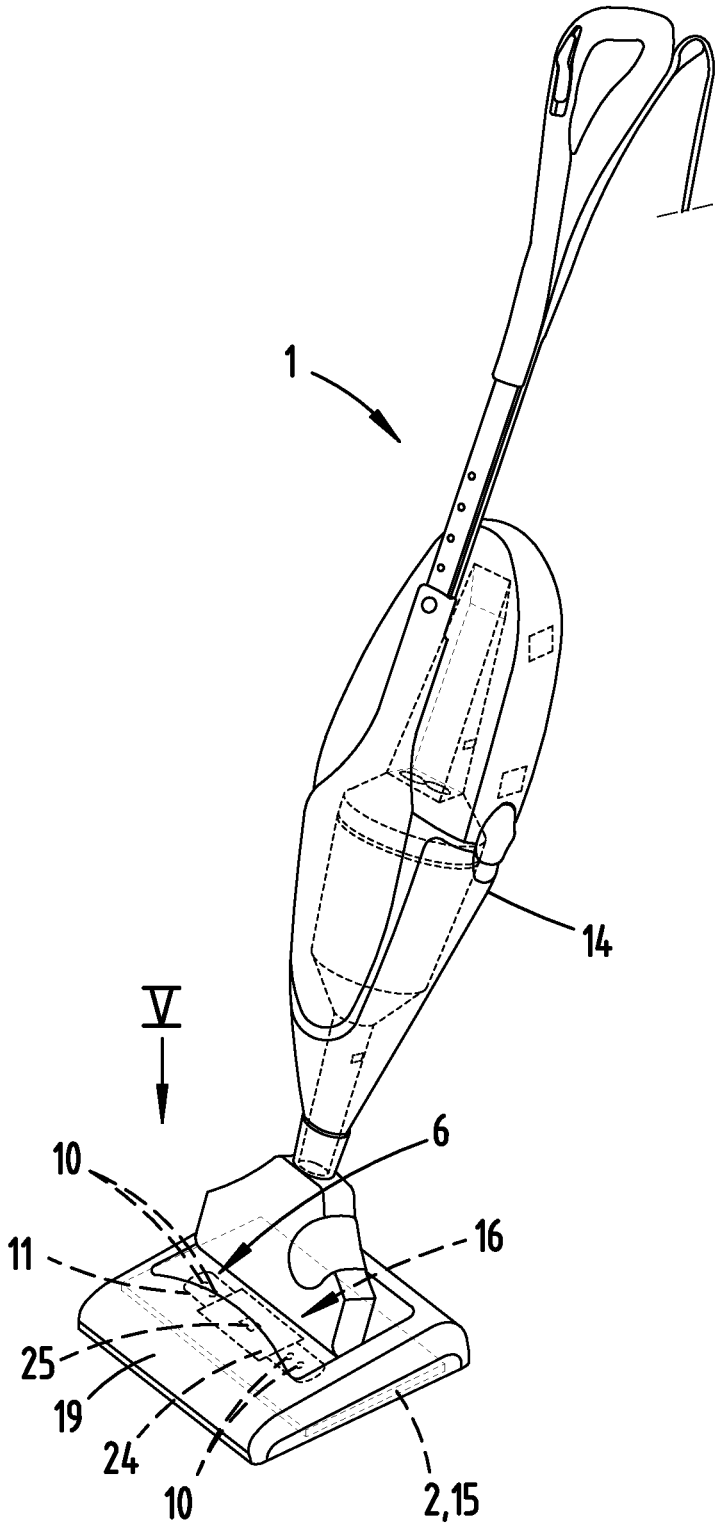
FIG. 2 shows a cleaning device according to a second embodiment.

FIG. 2 shows another potential embodiment of an inventive cleaning device 1. This cleaning device 1 is realized in the form of a wet-cleaning device. This cleaning device 1 likewise has a base unit 14 that may also comprise, for example, devices for a vacuum cleaning process, e.g., like the cleaning device 1 according to the embodiment illustrated in FIG. 1. According to FIG. 2, the base unit 14 is connected to an accessory 19 in the form of a wiping accessory. The wiping accessory has a wet-cleaning element 15, in this example a wiping plate that oscillates parallel to a surface to be cleaned and carries a (not-shown) cleaning cloth. The accessory 19 furthermore has a liquid application device 16, which in this example comprises a liquid container 24, a pump 25 and a flow channel 11 with a plurality of outlet openings 10. Liquid can be pumped from the liquid container 24 into the flow channel 11 and to the outlet openings 10 by means of the pump 25 such that liquid, particularly water or a cleaning liquid, is respectively transported from the liquid container 24 to the wet-cleaning element 15 or on the surface to be cleaned.

FIGS. 3 to 5 show different exemplary embodiments of the invention that can be used in a cleaning device 1 according to FIG. 1 and/or in a cleaning device 1 according to FIG. 2. A displaceable section 6, which in this example can be displaced by means of a displacement device 5, is respectively assigned to the flow channel 11 of the base unit 14 or the flow channel 11 of the accessory 19. The displacement device 5 can be optionally eliminated if a displacement of the section 6 is carried out manually, particularly by the manufacturer of the cleaning device 1.

FIG. 3 shows a first embodiment, in which the displaceable section 6 is a deflection element 17 arranged within the flow channel 11. The deflection element 17 can be displaced from a position, in which it abuts on an inner wall of the flow channel 11, into a position, in which it is pivoted away from the inner wall, by means of an actuator 18 of the displacement device 5. The displaceable section 6 may be assigned, for example, to the suction air region 12 of the flow channel 11 of the cleaning device 1 illustrated in FIG. 1 in order to serve as a deflector plate of sorts within the suction air region 12, wherein said deflector plate provokes an increased number of collisions with the vacuumed material particles drawn into the flow channel 11. For example, the actuator 18 assigned to the section 6 is a servomotor that causes the pivoting movement of the section 6. When the section 6 is displaced into the flow channel 11, crackling noises generated by the particles, e.g. crumbs, impacting on the section 6 can be generated in an amplified manner. In this way, the user can better perceive the crackling noises and is informed of the fact that the cleaning device 1 currently vacuums up larger particles, e.g. crumbs on a kitchen floor, and therefore properly fulfills its function.

According to an embodiment of the inventive method, the manufacturer of the cleaning device 1 may during the manufacture of the cleaning device 1 displace the displaceable section 6 into a position relative to the flow channel 11, which is particularly advantageous for a normal operating mode of the cleaning device 1 and especially leads to a desired adaptation of the soundscape of the cleaning device 1. The manufacturer may initially carry out a frequency analysis of the sound emitted by the cleaning device 1 in order to adapt the soundscape, e.g. to amplify a characteristic sound portion or to minimize an annoying resonant mode. For this purpose, a recording of the soundscape can be produced by means of a detection device, particularly a microphone. The signals measured by the detection device can be subsequently analyzed by a computing device. In this respect, a frequency spectrum of the sound generated by the cleaning device 1 particularly is generated and analyzed with respect to device-typical sound frequencies. For example, the device-typical sound frequencies may be frequencies, which are known to be generated when certain types of vacuumed material flow through the flow channel 11 or in certain operating modes and/or power settings of the cleaning device 1. If the computing device determines characteristic sound frequencies within the frequency spectrum, these sound frequencies can be compared with a predefined amplitude. In case the actual amplitude exceeds or falls short of the predefined amplitude, the section 6 can be displaced relative to the flow channel 11 or the device housing 7 in such a way that the amplitude of the respective sound frequency is changed in a desired direction, namely either increased or decreased depending on whether the manufacturer of the cleaning device 1 wants to amplify or minimize this sound frequency. In order to displace the section 6, the manufacturer can utilize the exemplary displacement device 5 with the actuator 18 illustrated in FIG. 3 in order to automatically displace the section 6. It is alternatively also possible that the manufacturer manually takes hold of and displaces the section 6 in order to achieve the same result. In this context, the automatic displacement is preferred, particularly if a section 6 is located in the flow channel 11. For example, the manufacturer of the cleaning device 1 can activate the displacement device 5 until the displaceable section 6, e.g. the deflection element 17 according to FIG. 3, reaches a position, in which the respective sound frequency has a desired amplitude. This is achieved by reducing a flow cross section of the flow channel 11 by means of a pivoting movement of the deflection element 17 such that the vacuumed material particles flowing through the flow channel 11 impact on the deflection element 17 more frequently and in the process generate crackling noises, which subsequently can be clearly perceived by the user of the cleaning device 1 and therefore indicate that the cleaning device 1 operates properly.

The section of the flow channel 11 illustrated in FIG. 3 may alternatively also be a section of the clean air region 13 of the cleaning device 1. Sound portions generated by the fan 8 itself are also carried along with the clean air in the clean air region 13 arranged on the output side of the fan 8. Such sound portions are generated by the movements of the fan blades of the fan 8, wherein the sound frequency of the sound generated by the fan 8 is defined by the number of fan blades, as well as the rotational frequency of the rotary shaft of the fan 8. This so-called blade pass frequency can be determined within the sound spectrum. The electric motor driving the fan 8 also generates characteristic sound frequencies that appear in the sound spectrum. The air flow flowing to the outlet opening 10 ultimately also generates characteristic sound frequencies that can be influenced with the displacement of the section 6 assigned to the flow channel 11. In order to absorb the blade pass frequency within the emission spectrum, for example, the displaceable section 6/the deflection element 17 can be displaced into the flow channel 11 until the amplitude of the characteristic sound frequency lies below a defined reference amplitude. In another instance, in which a noise formation should take place, for example, with the aid of the air flow within the flow channel 11, the deflection element 17 may form a displaceable the air separation edge that provokes a stall of the clean air flowing past and thereby generates a noise that gives the perceivable sound a different noise impression.

FIG. 4 shows another embodiment, in which the displaceable section 6 is a channel section of the flow channel 11 itself. The flow channel 11 is designed in a flexible manner, e.g. folded like an accordion, in the region of the displaceable section 6 and can be displaced out of its original position, for example, due to counterpressure of the displacement device 5. The original straight shape of the flow channel 11 is illustrated with broken lines in the figure. The continuous lines illustrate the shape of the flow channel 11 after the displacement of the displaceable section 6. According to this figure, the thusly produced curvature of the flow path within the flow channel 11 leads to an increased collision of vacuumed material particles with the inner wall of the flow channel 11. The collision noise is thereby amplified and can be better perceived by the user. The user is informed of the fact that vacuumed material currently is actually drawn into the cleaning device 1 and that the cleaning device 1 therefore properly fulfills its function or actually vacuums up crumbs.

The displaceable sections 6 of FIGS. 3 and 4 function correspondingly in the wet-cleaning device 1 illustrated in FIG. 2.

With respect to the wet-cleaning device illustrated in FIG. 2, in particular, FIG. 5 shows a flow channel 11 of variable size, wherein the width of said flow channel can be increased or decreased by displacing a section 6 of the flow channel wall (see arrow). In this way, the liquid flowing through the flow channel 11 respectively generates other sound frequencies or other sound frequencies are amplified or absorbed such that the perceivable overall noise likewise changes. For example, pumping noises generated by the pump 25 can thereby be reduced or a liquid transport to the wet-cleaning element 15 can be acoustically accentuated.

In addition to the functionality of the inventive displaceable section 6, the soundscape of the cleaning device 1 can also be changed by an activation of a driving motor or, for example, the pump 25. The change of the operation of the motor or the pump 25 makes it possible to generate certain sound frequencies, which in interaction with the inventive sound modification allow an improvement of the device sound. For example, the rotational frequency of a rotary shaft can also be adapted in order to influence the device sound in an agreeable manner. Furthermore, so-called sound synthesis methods may also be supplemented in order to admix individual or multiple synthetically generated sounds to the noise spectrum of the cleaning device 1.

The sound frequencies emitted by the cleaning device 1 are influenced, in principle, by a current operating mode or operating point of the cleaning device 1 or its components. This includes, for example, a current rotational speed of a driving motor of the fan 8 or the pump 25. The soundscape of the cleaning device 1 is also influenced by the use of a certain accessory 19 or by the type of surface to be cleaned, on which the cleaning device 1 is operated. It is therefore advisable that the displaceable section 6 also can be actively displaced after the manufacture of the cleaning device 1 in dependence on a current operating mode or operating point of the cleaning device 1. In this overall context, it may be particularly advantageous that the user can select a certain noise characteristic of the cleaning device 1 by means of an external terminal 26 illustrated in FIG. 6. It is alternatively also possible that a displacement of the displaceable section 6 is already caused directly by an actuation of the switch 23 of the cleaning device 1 illustrated in FIGS. 1 and 2. According to FIG. 6, different variations are available in case the user wants to select a certain soundscape independently of the current operating mode of the cleaning device 1. In this example, the user can select from soundscapes that are designated as "whisper-quiet", "competent" and "powerful." This makes it possible to optimally comply with the personal perception of each individual user of the cleaning device 1. When the user actuates one of multiple buttons 3 displayed on the external terminal 26, information on the desired soundscape to be adjusted is transmitted from the external terminal 26 to the control and evaluation unit 4 of the cleaning device 1 via the communication interface 20 of the cleaning device 1. The control and evaluation unit 4 subsequently controls the actuator 18 assigned to the displaceable section 6 in such a way that it displaces the section 6 into a certain position required for the selected soundscape. An example of a communication between the external terminal 26 and the cleaning device 1 resulting from a selection by a user is illustrated in FIG. 7.

The position of the displaceable section 6 to be adjusted for the selected soundscape may be stored in a (not-shown) memory of the cleaning device 1. The control and evaluation unit 4 of the cleaning device 1 retrieves the specified position and correspondingly controls the displaceable section 6 until the position to be adjusted is reached.

According to the invention, the user may similarly use the switch 23 of the cleaning device 1 arranged on the handle 22 of the cleaning device 1 for selecting a certain operating mode, e.g. an operating mode with a defined power setting of the fan 8. A characteristic frequency spectrum corresponding to the respective operating mode may be stored in the memory, wherein this characteristic frequency spectrum can be adjusted with a certain position of the displaceable section 6 or certain positions of multiple displaceable sections 6. The control and evaluation unit 4 of the cleaning device 1 can subsequently transmit a control command to the displacement device 5 in order to adjust the position of the section 6 in accordance with the operating mode selected by the user.

Although not illustrated in the figures, the flow channel 11 may comprise multiple displaceable sections 6 that as a whole are suitable for influencing the soundscape in various ways. It is also possible to provide displaceable sections 6 that are not assigned to the flow channel 11 of the cleaning device 1, but rather to other components of the cleaning device 1 that emit, amplify or reduce certain sound frequencies. All in all, the overall noise of the cleaning device 1 can thereby be advantageously adapted.

Although only a few embodiments of the present invention have been shown and described, it is to be understood that many changes and modifications may be made thereunto without departing from the spirit and scope of the invention.

| List of Reference Symbols | |
|---|---|
| 1 | Cleaning device |
| 2 | Cleaning mechanism |
| 3 | Button |
| 4 | Control and evaluation unit |
| 5 | Displacement device |
| 6 | Section |
| 7 | Device housing |
| 8 | Fan |
| 9 | Inlet opening |

-continued

| List of Reference Symbols | |
|---|---|
| 10 | Outlet opening |
| 11 | Flow channel |
| 12 | Suction air region |
| 13 | Clean air region |
| 14 | Base unit |
| 15 | Wet-cleaning element |
| 16 | Liquid application device |
| 17 | Deflection element |
| 18 | Actuator |
| 19 | Accessory |
| 20 | Communication interface |
| 21 | Shaft |
| 22 | Handle |
| 23 | Switch |
| 24 | Liquid container |
| 25 | Pump |
| 26 | External terminal |
| 27 | Suction mouth |
| 28 | Vacuumed material chamber |

What is claimed is:

1. A method for changing a sound spectrum of a sound emitted by a cleaning device, wherein the cleaning device comprises a cleaning mechanism for cleaning a surface, a detection device with a sensor for detecting the sound emitted during the cleaning activity, a computing device in the form of a processor for generating and analyzing the sound spectrum of the detected sound, a device housing with a flow channel, a section of the flow channel that can be displaced relative to the device housing, a motor-driven displacement device for displacing the displaceable section, a control unit in the form of a processor for controlling the displacement device, and a memory, in which a nominal amplitude of at least one sound frequency contained in the sound spectrum is stored, wherein the method comprises the following steps:

carrying out with the cleaning device a cleaning activity on a surface to be cleaned, emitting device-typical sound by the cleaning device, detecting the emitted sound by means of the detection device, generating and analyzing the sound spectrum of the detected sound by means of the computing device, wherein the analysis includes, with respect to at least one sound frequency contained in the sound spectrum, a comparison of an actual amplitude of the detected sound frequency with a nominal amplitude of the sound frequency stored in a memory, and automatically controlling the displacement device with the control unit to displace the displaceable section in dependence on the analysis result until the actual amplitude of the detected sound frequency corresponds to the stored nominal amplitude of the sound frequency.

2. The method according to claim 1, further comprising transmitting by a user a reference spectrum with a plurality of sound frequencies and nominal amplitudes assigned to the sound frequencies to the memory of the cleaning device by means of a data communication interface of the cleaning device.

3. The method according to claim 1, further comprising transmitting by a user information to the effect whether a current sound of the cleaning device is perceived as agreeable or objectionable to the computing device by means of a data communication interface of the cleaning device, wherein the amplitudes of the sound frequencies contained in a frequency spectrum perceived as agreeable are stored in the memory as nominal amplitudes and used by the computing device for the comparison with current actual amplitudes in future analyses.

4. The method according to claim 1, wherein sound frequencies contained in the sound are continuously detected, compared and influenced by displacing the displaceable section during the operation of the cleaning device.

5. The method according to claim 1, wherein a nominal amplitude of a sound portion is stored in the memory in association with a certain parameter of the cleaning device or a certain parameter of the surroundings, wherein the computing device accesses upon a subsequent occurrence of the stored parameter the nominal amplitude of the sound frequency stored for the current parameter for the comparison of the actual amplitude of the sound frequency contained in the sound spectrum.

6. The method according to claim 1, wherein a position of the displaceable section to be adjusted by means of the displacement device is stored in the memory in association with a certain parameter of the cleaning device or a certain parameter of the surroundings, wherein the control unit accesses upon the subsequent occurrence of the stored parameter the stored position to be adjusted for the current parameter for the control of the displacement device.

7. The method according to claim 5, wherein the parameter is at least one of the following: operating mode of the cleaning device, rotational speed of a fan motor of the cleaning device, flow speed within the flow channel of the cleaning device, pumping power of a liquid pump of the cleaning device, power setting of the cleaning device, floor type of the surface to be cleaned, accessory connected to the cleaning device, suction nozzle connected to the cleaning device, wiping element connected to the cleaning device.

8. A method for influencing a device-typical sound emission of a cleaning device, wherein the cleaning device has a device housing and a cleaning mechanism for carrying out a cleaning activity on a surface to be cleaned, wherein the cleaning device emits the device-typical sound while carrying out the cleaning activity, wherein the method comprises detecting an analyzing the device-typical sound with respect to at least one sound frequency contained therein, and displacing a displaceable section assigned to a flow channel of the cleaning device relative to the flow channel or the device housing in dependence on the analysis result until a characteristic sound frequency for the cleaning activity emitted by the cleaning mechanism has a defined amplitude.

9. The method according to claim 8, wherein a flexible section of the flow channel or a deflection element that can be displaced into the flow channel is displaced.

10. The method according to claim 8, wherein the displaceable section is displaced until the amplitude of the characteristic sound frequency reaches a maximum.

11. The method according to claim 8, wherein the amplitude of the characteristic sound frequency for the cleaning activity is adjusted in dependence on an operating mode of the cleaning device, a power setting of the cleaning device, a floor type of the surface to be cleaned or an accessory connected to the cleaning device.

12. The method according to claim 11, wherein the accessory is a suction nozzle that is separably connected to the cleaning device or a wiping element that is separably connected to the cleaning device.

13. The method according to claim 8, wherein different positions of the displaceable section to be adjusted for different operating modes, for different power settings of the cleaning device or for different accessories connectable to the cleaning device are predefined by the manufacturer and stored in a memory of the cleaning device.

14. The method according to claim 13, wherein a control and evaluation unit of the cleaning device accesses the stored positions, determines a position to be adjusted in dependence on an operating mode adjusted by a user, a power setting adjusted by a user or an accessory connected to the cleaning device and transmits a control command to an actuator assigned to the displaceable section in order to displace the section into the position to be adjusted.

15. The method according to claim 8, further comprising manually transmitting by a user of the cleaning device a control command for displacing the section to a control and evaluation unit of the cleaning device.

16. The method according to claim 15, wherein the user transmits the control command by actuating a selector switch for selecting an operating mode or a power setting of the cleaning device.

* * * * *